US011000872B2

(12) United States Patent
Speck

(10) Patent No.: US 11,000,872 B2
(45) Date of Patent: May 11, 2021

(54) SPRAY GUN CLEANING SYSTEM USING AEROSOL CAN

(71) Applicant: PRO FORM PRODUCTS LIMITED, Milton (CA)

(72) Inventor: James H. Speck, Campbellville (CA)

(73) Assignee: Pro Form Products Limited, Ontario (CA)

( * ) Notice: Subject to any disclaimer, the term of this patent is extended or adjusted under 35 U.S.C. 154(b) by 0 days.

(21) Appl. No.: 16/535,785

(22) Filed: Aug. 8, 2019

(65) Prior Publication Data

US 2020/0047211 A1 Feb. 13, 2020

Related U.S. Application Data

(60) Provisional application No. 62/716,745, filed on Aug. 9, 2018, provisional application No. 62/718,758, filed on Aug. 14, 2018.

(51) Int. Cl.

| | |
|---|---|
| ***B05B 15/55*** | (2018.01) |
| ***B08B 9/032*** | (2006.01) |
| ***B05B 11/00*** | (2006.01) |

(52) U.S. Cl.
CPC ..... *B05B 15/557* (2018.02); *B05B 11/0008* (2013.01); *B05B 11/0029* (2013.01); *B08B 9/0321* (2013.01)

(58) Field of Classification Search
None
See application file for complete search history.

(56) References Cited

U.S. PATENT DOCUMENTS 3,146,950 A * 9/1964 Lancaster ..... B29B 7/7447 239/128
2009/0308946 A1* 12/2009 Dube ..... B65D 83/207 239/9

* cited by examiner

*Primary Examiner* — Eric W Golightly
(74) *Attorney, Agent, or Firm* — Fay Sharpe LLP

(57) ABSTRACT

A spray gun cleaning assembly includes an aerosol can and a connecting assembly connecting the aerosol can to a spray gun for cleaning the spray gun. The connector assembly includes a first threaded connector threadedly coupled to the aerosol can; and a second threaded connector threadedly connected to the spray gun. An elongated tube is connected at opposite ends to the first and second threaded connectors. A shut-off valve assembly is operatively coupled to the elongated tube for opening and closing the connecting assembly for providing pressurized air or cleaning fluid to the spray gun.

6 Claims, 9 Drawing Sheets

SPRAY GUN CLEANING SYSTEM USING AEROSOL CAN

CLAIM OF PRIORITY

This application claims priority to provisional application Ser. No. 62/716,745, filed on Aug. 9, 2018 and Provisional Patent Application Ser. No. 62/718,758, filed on Aug. 14, 2018, the entirety of which are hereby incorporated by reference.

BACKGROUND OF THE DISCLOSURE

The present disclosure relates to the art of using and cleaning paint spray guns. In particular, it finds application with an aerosol can injection system which injects pressurized air or a cleaning fluid from an aerosol can into a spray gun to clean paint and paint residue from the internals of the gun.

An existing method for cleaning painting spray guns or heads is shown in FIG. 1. In this example, the user holds the spray gun A with one hand and a pressurized aerosol can B with the other hand. The can further has a straw S attached to the nozzle N. The straw is pointed into the spray head and the nozzle is depressed thereby injecting or spraying the pressurized air or fluid from the aerosol into the spray head thus removing paint residue and cleaning the spray head.

A problem with this system is it requires both hands of the user and it is not always totally effective since there is no airtight connection formed between the spray gun and the can.

Thus, there is a need for a new improved method of cleaning paint spray gun using an aerosol can which has a direct and tight connection. The present disclosure provides a new and improved aerosol can cleaning system which overcomes the above-referenced deficiencies of the prior systems while providing better and more advantageous overall results.

SUMMARY OF THE DISCLOSURE

In accordance with one embodiment of the disclosure, an aerosol can system is provided that is easily portable and can be readily used in the field. Another aspect of the aerosol can system is that it is inexpensive. Yet another advantage of the aerosol can system is that it allows a tight connection with a spray gun.

In accordance with a preferred embodiment of the disclosure, the pressurized gun cleaner includes the ability to spray product out of a spray gun using a pressurized aerosol to feed materials with the cleaner and assisted by compressed air from an air compressor (line supplied) or a compressed gas such as a nitrogen (small container such as an aerosol can) connected to where the air compressor line connected. This allow full mobility anywhere including at heights without a cumbersome air line hooked to the gun.

In accordance with another embodiment of the disclosure, a pressurized aerosol container or can is connected to a paint gun via a connector assembly which allows the gun to be cleaned directly under pressure from the aerosol can. The application is simply to open the valve releasing the cleaner into the gun then pull the trigger on the gun and the cleaner will be transferred through the gun leaving the gun perfectly cleaned with no residue of paint or coating.

In accordance with a preferred embodiment of the disclosure, a spray gun cleaning assembly includes an aerosol can and a connecting assembly connecting the aerosol can to a spray gun. The connector assembly has a first threaded connector threadedly coupled to the aerosol can. A second threaded connector is threadedly connected to the spray gun. An elongated member is connected at opposite ends to the first and second threaded connectors. A valve assembly is operatively coupled to the elongated member for opening and closing the connecting assembly.

In accordance with another embodiment of the disclosure, a method of cleaning a spray gun using an aerosol can, includes the steps of removing a paint container from a spray gun; connecting a connector assembly at a first end to an aerosol can by inserting a male thread valve into a female internal thread valve on the can; connecting the connector assembly at a second end to a spray gun by connecting a first coupler and fitting to a female threaded member of the spray gun; providing an elongated tube connecting the first end of the connector assembly to a second end of the connector assembly; providing a shut-off valve between the first and the second end of the connector assembly and connected to a second coupler; opening the shut-off valve by rotating an arm of the shut off valve counterclockwise, thereby releasing pressurized air or cleaning fluid from the aerosol can into the spray gun.

Still further aspects of the present disclosure will become apparent upon reading and understanding the following detailed description of the preferred embodiments.

BRIEF DESCRIPTION OF THE DRAWINGS

The disclosure may take form in various parts and arrangements of parts. The drawings are only for purposes of illustrating a preferred embodiment and are not to be construed as limiting the disclosure.

DETAILED DESCRIPTION OF THE PREFERRED EMBODIMENTS

With reference now to FIGS. 2-8, an aerosol can cleaning system in accordance with a preferred embodiment of the disclosure is shown and described. A pressurized spray gun cleaner assembly includes the ability to spray product out of a spray gun using a pressurized aerosol can 90 to feed materials with the cleaner and assisted by compressed air from an air compressor (line supplied) or a compressed gas such as a nitrogen (small container such as an aerosol can) connected to where the air compressor line connected. This allows full mobility anywhere including at heights without a cumbersome air line hooked to the gun.

The pressurized aerosol cleaner assembly is connected to an aerosol can 90 and a spray paint gun A via a connector assembly C which allows the spray gun to be cleaned directly under pressure from the aerosol can. The application is simply to open the valve releasing the cleaner assembly into the gun then pull the trigger on the gun and the cleaner will be transferred through the gun leaving the gun perfectly cleaned with no residue of paint or coating.

Figure 1:
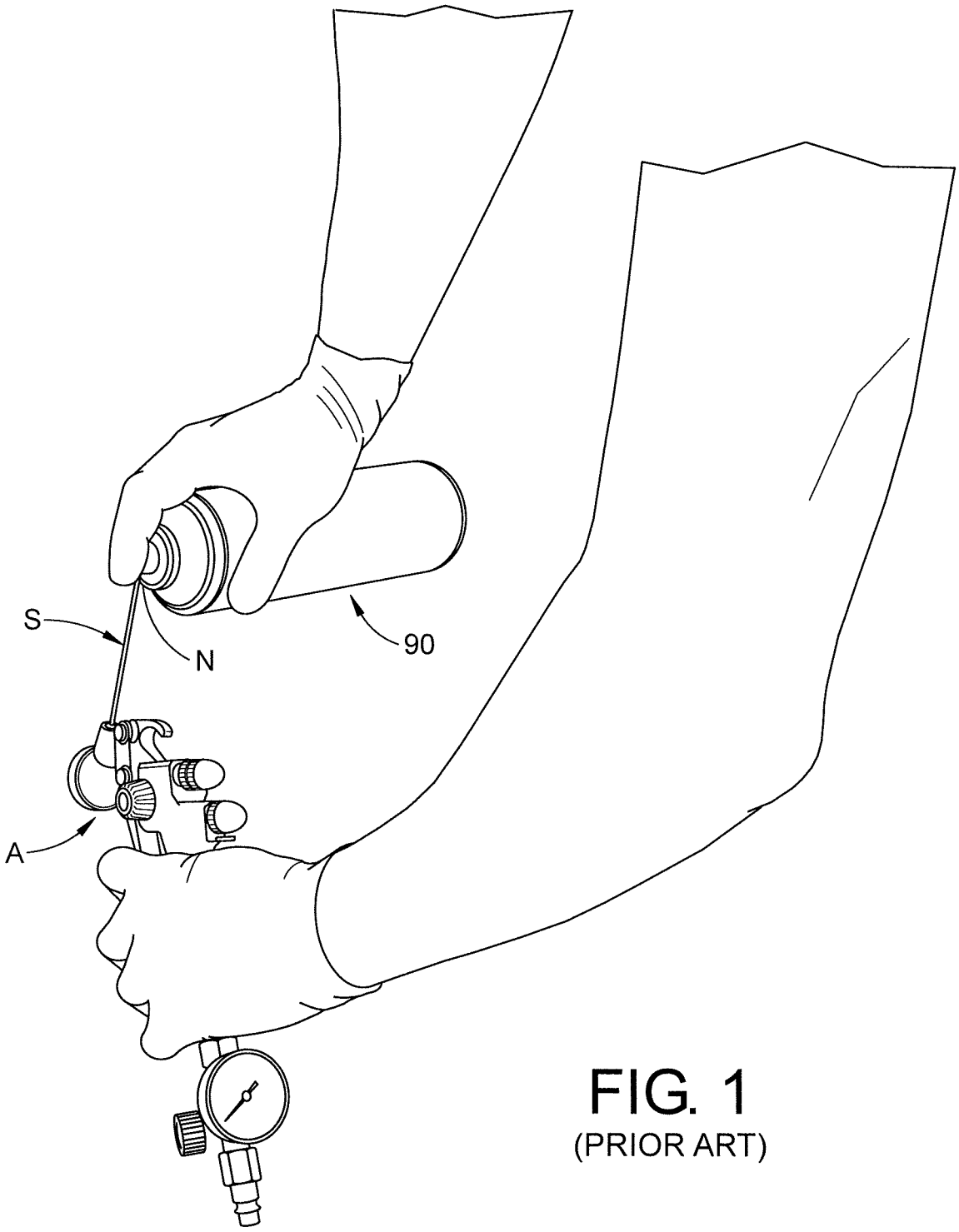
FIG. 1 (PRIOR ART)
FIG. 1 is a perspective view of an existing aerosol can filling pump.
Figure 2:
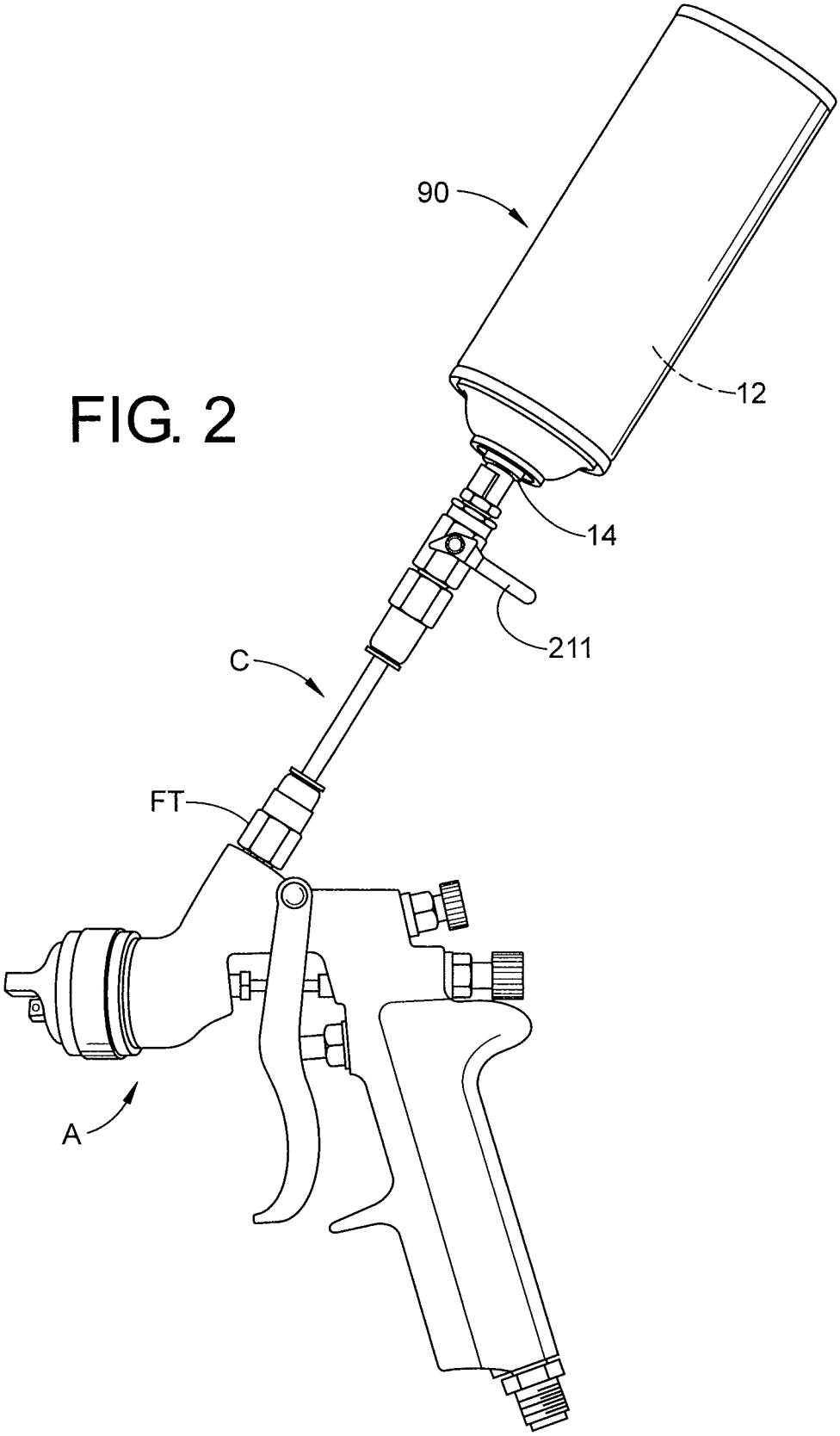
FIG. 2 is a side elevational view illustrating a spray gun cleaning system in a closed position in accordance with a preferred embodiment of the disclosure.

Referring now to FIG. 2, an aerosol can 90 can be filled with product such as pressurized air or fluid 12 and has a valve such as male valve 96.

Aerosol can 90 with product 12 therein can be various sizes, such as 16 (sixteen) ounces or 20 (twenty) ounces. However, other size cans are contemplated by the disclosure.

A connecting device C has a threaded connector on each side. The device is controlled by a valve at one end. The flows from the can 90 to a spray gun A.

Before attaching the device C to an aerosol can 90, shut-off valve 204 must be in the fully off position. The spray head cap is removed from the can pressurized valve air in cleaning fluid.

The threaded male hub 96 of the can 90 is screwed into the internally threaded openings on the female aerosol valve 200. This results in opening of the valve 200 which releases pressurized air or cleaning fluid out of the can. The can must not be removed once the valve is opened.

Once the can 90 is connected to the device C the pressure is held at the shut-off valve 204. The valve 204 is opened, the high pressure of the can 90 will force the pressurized air or cleaning fluid content down a rigid airline tube 208 into the spray gun.

Figure 3:
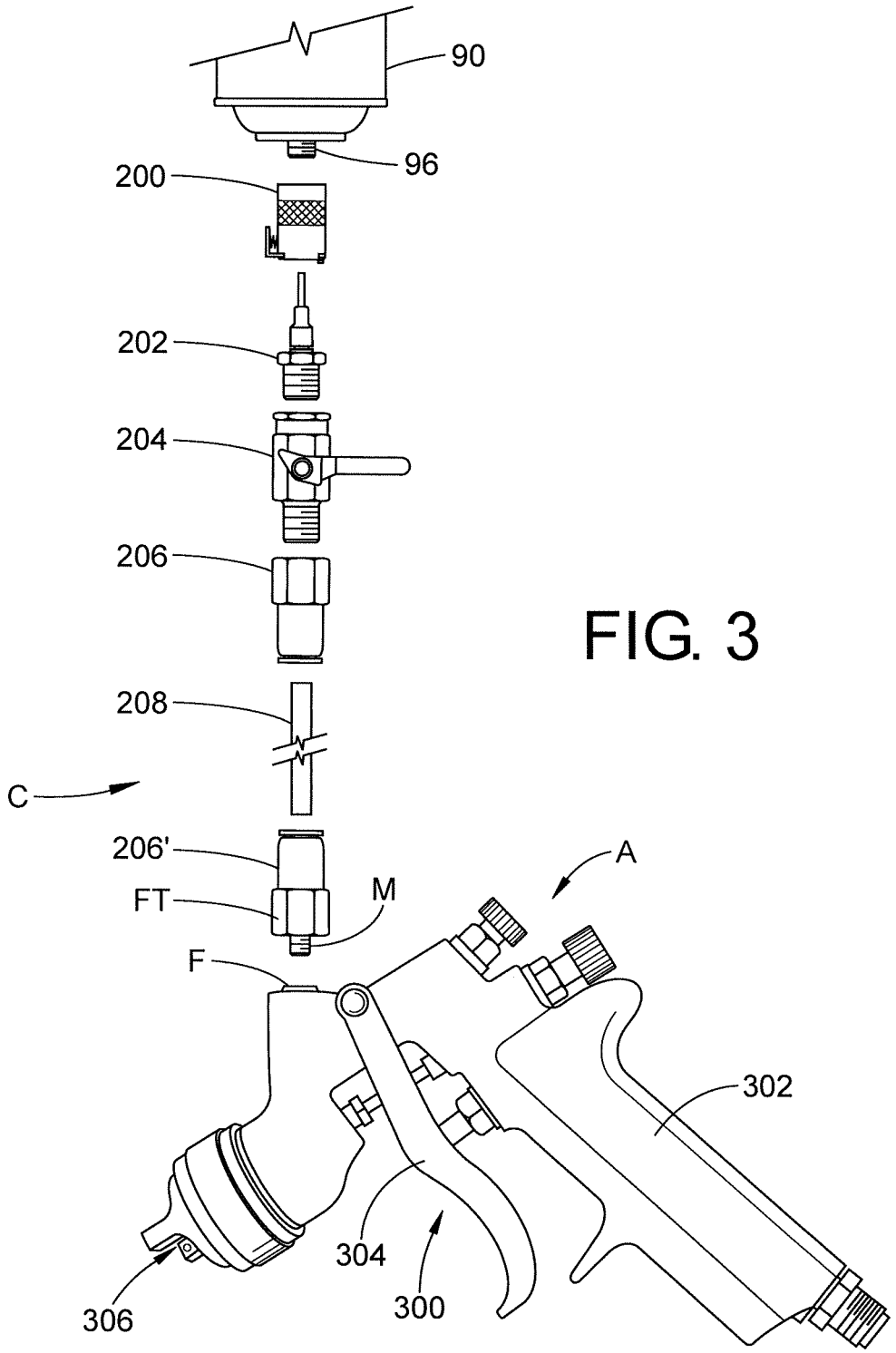
FIG. 3 is an exploded elevational view of the spray gun cleaning system of FIG. 2.

Referring now to FIG. 3, the specific components of the connecting device C are as follows: an internal thread aerosol valve 200 which is attached to can 90; a first male aerosol valve 202; a shut-off valve 204; a hose coupler 206; a rigid airline hose or tube 208; a second hose coupler 206'. A fitting FT is coupled to hose coupler 206'. Fitting FT has a male fitting M which threadedly engages female thread member F of spray gun A. Spray gun A has a body 300, a handle 302, and a trigger 304 which is depressed to spray paint on liquid from nozzle or opening 306.

Figure 4A:
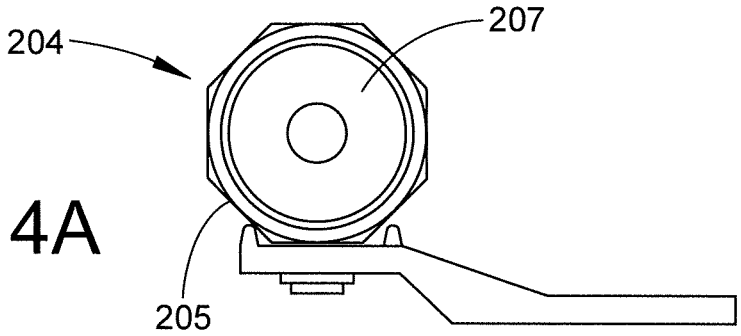
FIG. 4A is a top plan view of an aerosol container locking mechanism in accordance with another embodiment of the disclosure.
Figure 4B:
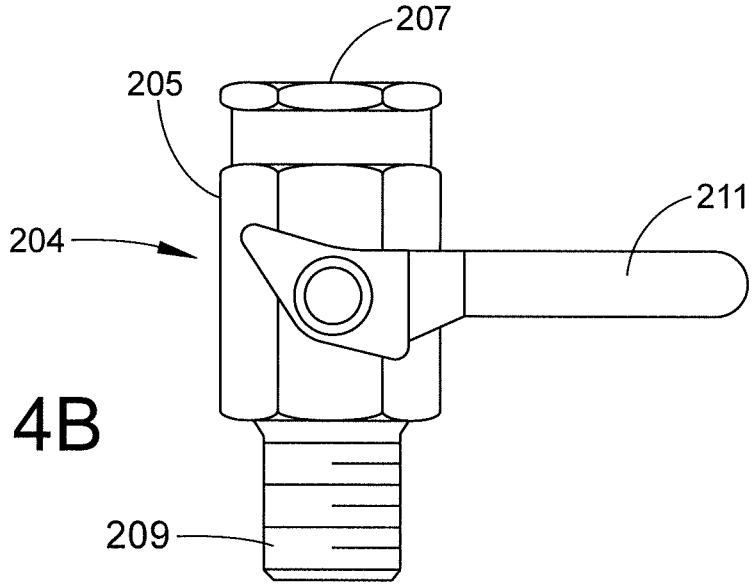
FIG. 4B is a side elevational view of the locking mechanism of FIG. 4A.

Referring now to FIGS. 4A and 4B, the details of the shut-off valve 204 are shown. Shut-off valve 204 has a body 205, a threaded opening 207 at an upper end and a threaded member 209 at a lower end. A rotating or pivoting arm 211 rotates up and down between valve open and valve closed positions. Upper threaded opening 207 receives a threaded portion of the male valve, wherein threaded member 207 is received by a threaded opening of hose coupler 206.

Figure 5A:
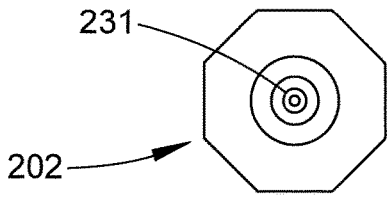
FIG. 5A is a top plan view of a male aerosol valve.
Figure 5B:
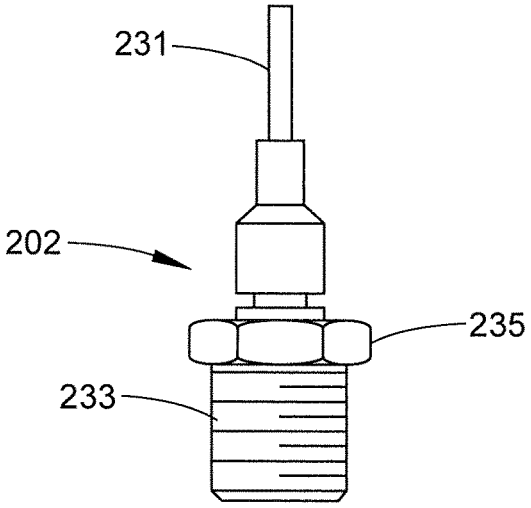
FIG. 5B is a side elevational view of the male aerosol valve of FIG. 5A.

Referring to FIGS. 5A and 5B, the details of the male aerosol valve 202 are shown. Specifically, valve 202 has a tip 231 which is inserted into an opening in internal thread female aerosol valve 200 and a threaded portion 233 of valve 202 extends from housing 235 is threaded into threaded opening of hose coupler 206.

Figure 6A:
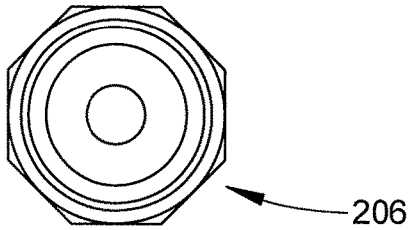
FIG. 6A is a top plan view of a hose coupler in accordance with another embodiment of the disclosure.
Figure 6B:
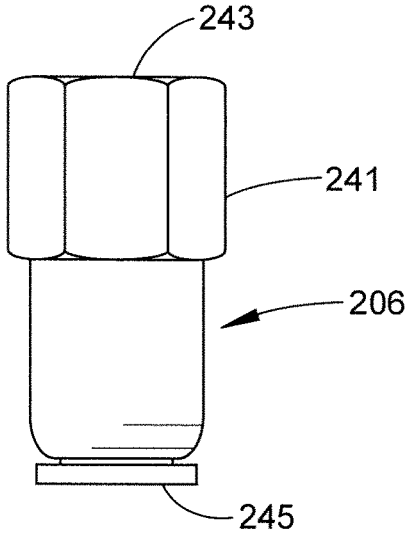
FIG. 6B is a side elevational view of the hose coupler of FIG. 6A.

Referring to FIGS. 6A and 6B, the details of hose coupler 206 are shown. Hose coupler 206 has a body 241, a first threaded opening 243 and a second threaded opening 245. First threaded opening 243 receives threaded portion 233 of male valve 202, while second threaded opening 245 receives an end of rigid airline tube 208.

Figure 7A:
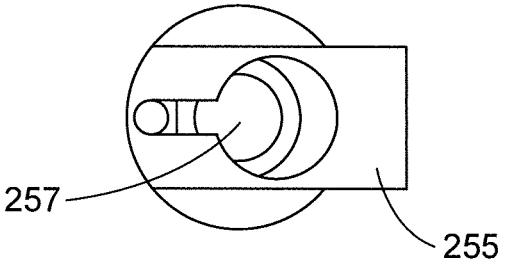
FIG. 7A is a top plan view of an internal thread valve.
Figure 7B:
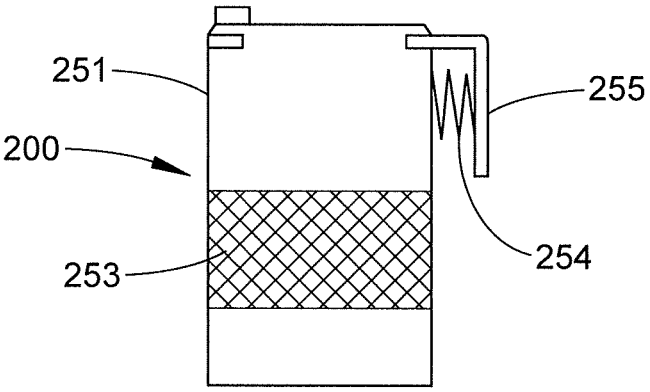
FIG. 7B is a side elevated view of an internal thread valve.

Referring now to FIGS. 7A and 7B, the details of internal thread aerosol valve 200 are shown. The valve 200 has a body 251, which has an internal threaded opening 253, and a spring (spring 254) loaded shut-off member 255 which opens and closes the valve opening 257. Valve 200 is inserted into aerosol can 90.

Figure 9:
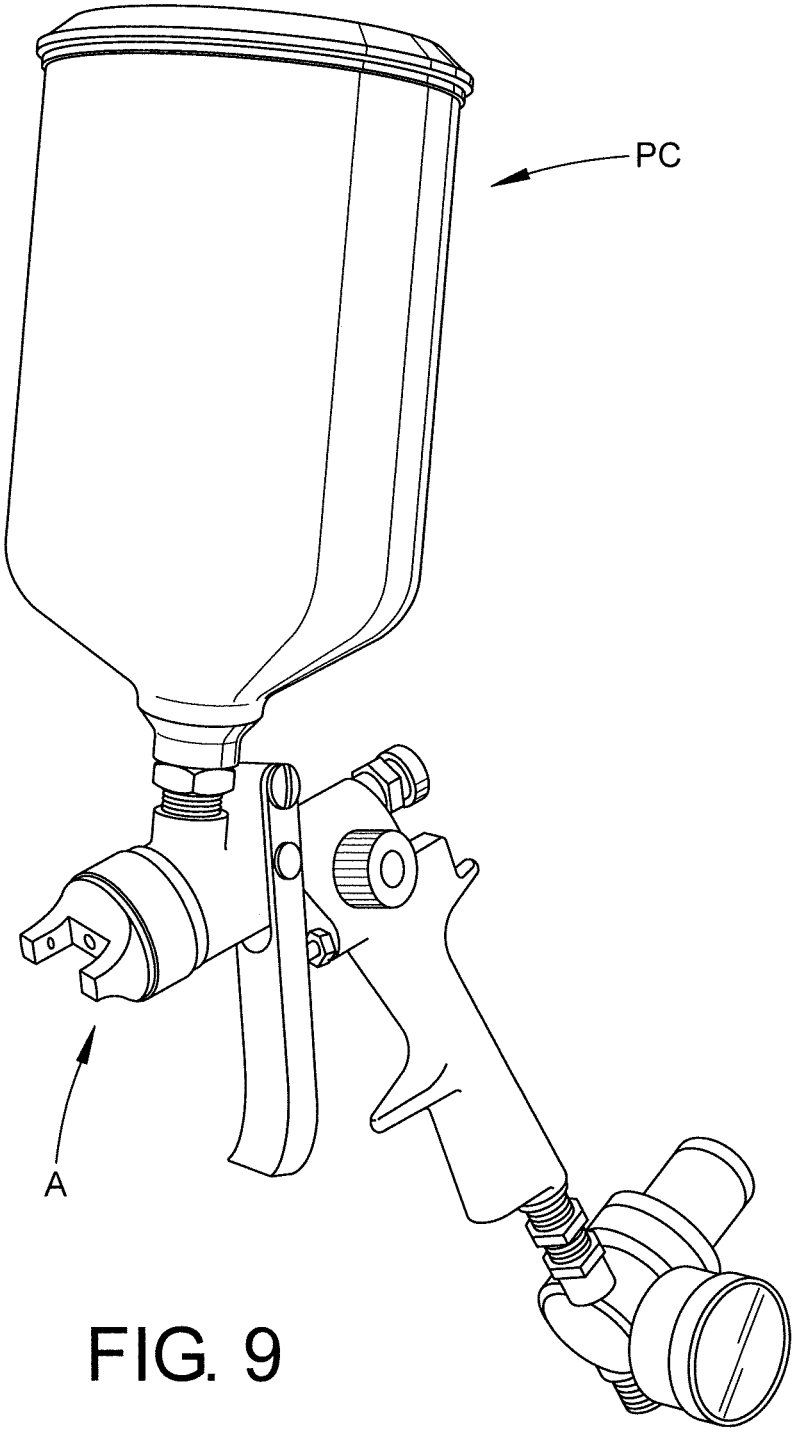
FIG. 9 is a perspective view of a spray gun with a paint cup threaded thereon.
Figure 10:
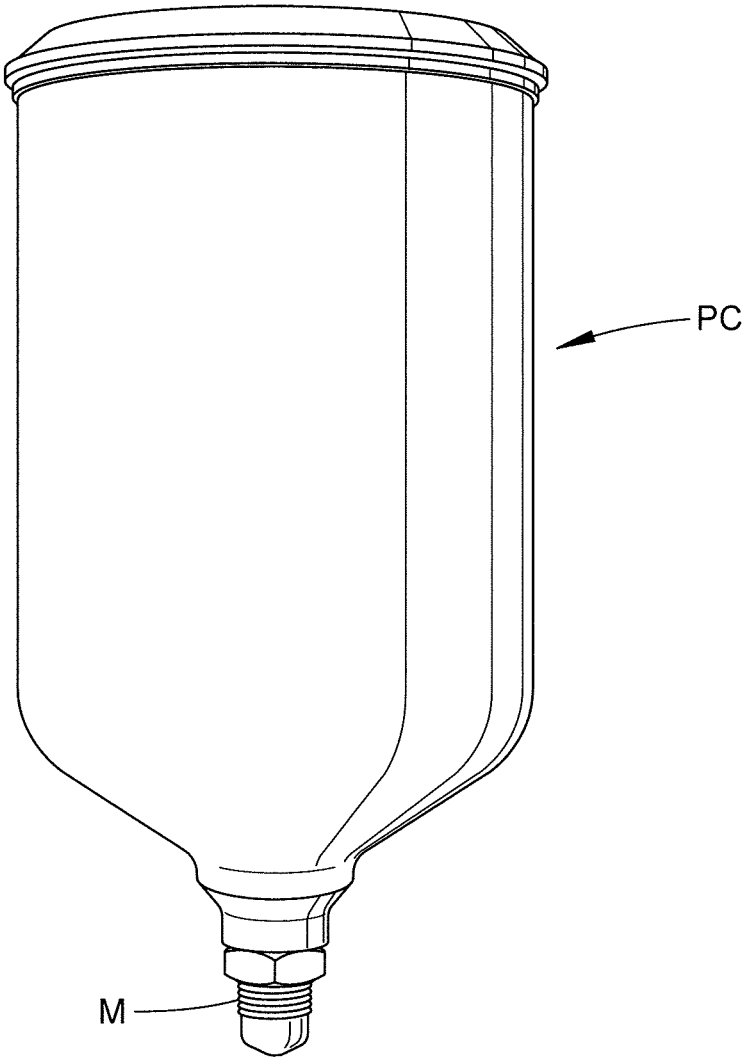
FIG. 10 is a perspective view of a paint cup showing male threads.

Referring to FIGS. 9 and 10, a spray gun A originally has a paint cup PC attached to a female threaded member F (See FIG. 3).

The paint cup PC has a male threaded portion M which mates with the female threaded member F. Then the paint is distributed through the spray gun to be sprayed. accordance with a preferred embodiment of the disclosure, the pressurized gun cleaner includes the ability to spray product out of a spray gun using a pressurized aerosol to feed materials with the cleaner and assisted by compressed air from an air compressor (line supplied) or a compressed gas such as a nitrogen (small container such as an aerosol can) connected to where the air compressor line connected. This allow full mobility anywhere including at heights without a cumbersome air line hooked to the gun.

To clean the spray gun, the paint cup PC is removed and a fitting FT is provided which has the same male threads M as the paint cup PC. Various fittings can be provided based on particular spray guns to match corresponding male or female threads. The fitting is threaded onto female thread member F, and the hose coupler 206' is attached to the fitting. Alternately, the hose coupler and fitting can be formed together as a single piece. The cleaning system then sends pressurized air or cleaning fluid through the areas of the spray gun that have paint residue.

To connect the can and the spray gun, before starting, the shut-off valve 204 must be in the closed position (FIG. 2). That is, the swing arm 211 will be perpendicular to the device when closed. Once the can is prepped with the appropriate housing, the core of the device C can then be inserted. One side of the device C at male valve 202 is pressed into the female valve 200 on the can 90. This will be pushed down until a "click" noise is heard and the device is locked. This activates the valve 200 and releases the pressure to the shut-off valve 204. The connection is completed by pressing the other side of the device C into the spray gun A at hose coupler 206' (which is substantially the same as coupler 206) and a fitting FT to female thread member F on the spray gun. (See FIGS. 2, 3, 8). Pressure is released to the shut-off valve 204. The assembly is now completely assembled.

Figure 8:
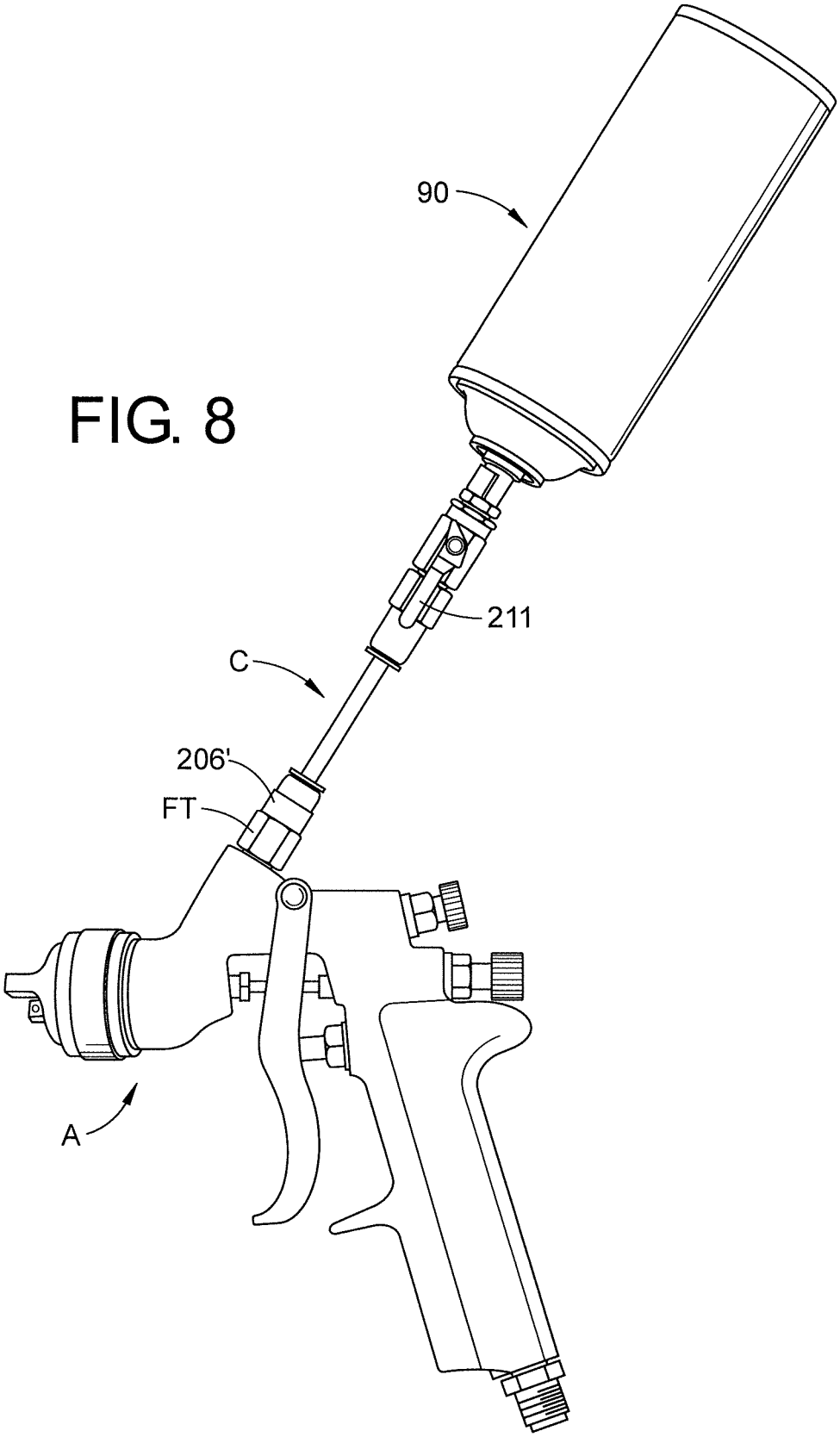
FIG. 8 is a side elevated view of the spray gun cleaning system in an opened position.

Referring to FIG. 8, once the can is connected to the device C and pressure is held at the shut-off valve 204 is opened by rotating arm 211 counter-clockwise, sending the pressurized air or cleaning fluid from the aerosol can to the spray gun through tube 208 to valve 206.

An airtight connection is formed between the aerosol can and the spray gun to thoroughly remove paint residue and other material from the gun.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the above described embodiments and appended claims or the equivalents thereof.

The invention claimed is:

1. A spray gun cleaning assembly comprising:
an aerosol can;
an internal thread aerosol valve coupled to said aerosol can;
a connecting assembly connecting said aerosol can to an associated spray gun;
wherein said connecting assembly comprises:
a first threaded connector threadedly coupled to said aerosol can;
a second threaded connector threadedly connected to said associated spray gun;
an elongated member connected at opposite ends to said first and second threaded connectors;
and a valve assembly operatively coupled to said elongated member for opening and closing said connecting assembly;
wherein a male aerosol valve is coupled to said internal thread aerosol valve and to said first threaded connector;
wherein said male aerosol valve comprises:
a tip inserted into an opening in said internal thread aerosol valve and a threaded portion threaded into said first threaded connector.

2. The spray gun cleaning assembly of claim 1, further comprising a male fitting which couples to said second threaded connector and to a female fitting on said associated spray gun.

3. The spray gun cleaning assembly of claim 2, wherein said valve assembly comprises:
a body;
a first threaded opening at an upper end;
a second threaded opening at a lower end; and
a rotatable arm which rotates between open and closed valve positions.

4. A spray gun cleaning assembly comprising:
an aerosol can;
an internal thread aerosol valve coupled to said aerosol can;
a connecting assembly connecting said aerosol can to an associated spray gun;
wherein said connecting assembly comprises:
a first threaded connector threadedly coupled to said aerosol can;
a second threaded connector threadedly connected to said associated spray gun;
an elongated member connected at opposite ends to said first and second threaded connectors;
and a valve assembly operatively coupled to said elongated member for opening and closing said connecting assembly;
wherein a male aerosol valve is coupled to said internal thread aerosol valve and to said first threaded connector;
said male aerosol valve comprising a tip inserted into an opening of said internal thread aerosol valve and a threaded portion threaded into said first threaded connector;
wherein said first threaded connector comprises:
a body and a first threaded opening and a second threaded opening, wherein said first threaded opening receives said threaded portion of said male aerosol valve and said second thread opening receives an end of said elongated member.

5. The spray gun cleaning assembly of claim 1, wherein said elongated member comprises a rigid airline tube.

6. The spray gun cleaning assembly of claim 1, wherein said internal thread aerosol valve comprises:
a body having an internal threaded opening and a spring loaded shut off member which opens and closes said internal threaded opening.

* * * * *